US005694799A

United States Patent [19]

Wolpert et al.

[11] Patent Number: 5,694,799

[45] Date of Patent: Dec. 9, 1997

[54] HOT-ROLLING PROCESS AND HOT-ROLLING MILL FOR METAL STRIP

[75] Inventors: Waldemar Wolpert; Friedrich Heymann; Manfred Möhlenkamp, all of Dinslaken; Günter Pietzko, Essen, all of Germany

[73] Assignee: SMS Schloemann-Siemag Aktiengesellschaft, Dusseldorf, Germany

[21] Appl. No.: 211,846

[22] PCT Filed: Oct. 8, 1992

[86] PCT No.: PCT/EP92/02314

§ 371 Date: May 10, 1994

§ 102(e) Date: May 10, 1994

[87] PCT Pub. No.: WO93/07974

PCT Pub. Date: Apr. 29, 1993

[30] Foreign Application Priority Data

Oct. 18, 1991 [DE] Germany ..... 41 34 599.1

[51] Int. Cl.[6] ..... B21B 27/10

[52] U.S. Cl. ..... 072/43; 72/201; 72/365.2

[58] Field of Search ..... 72/39, 41, 43, 72/201, 236, 365.2

[56] References Cited

U.S. PATENT DOCUMENTS

| | | | |
|---|---|---|---|
| 3,301,029 | 1/1967 | Fritzlen et al. | 72/42 |
| 3,911,704 | 10/1975 | Bridenbaugh et al. | 72/42 |
| 4,247,047 | 1/1981 | Schaming | 72/201 |
| 4,644,774 | 2/1987 | van Steden | 72/201 |

FOREIGN PATENT DOCUMENTS

| | | | |
|---|---|---|---|
| 1 427 803 | 4/1969 | Germany . | |
| 2 156 707 | 7/1972 | Germany . | |
| 57-103718 | 6/1982 | Japan | 72/201 |
| 62-227510 | 10/1987 | Japan | 72/201 |

OTHER PUBLICATIONS

Soviet Inventions Illustrated, Section Ch, Week 8650, Dec. 24, 1986, Derwent Publications Ltd., London, England, Class M21, An 86-331186/50 & SU, A, 1 227 275 (Ferr Metal Effl Purif) Apr. 30, 1986.

Database WPI, Section Ch, Weel 7833, Derwent Publications Ltd., London, England; Class M21, An 78-6000A (33) & SU, A, 571 313 (Moscow Steel Alloys Inst.) Sep. 30, 1977.

Patent Abstracts of Japan, vol. 3, No. 3 (C-33), 16 Jan. 1979 & JP, A, 53 127 351 (Hitachi Seisakusho) 11 Jul. 1978.

Steel in the USSR. Bd. 18, No. 2, Feb. 1988, London, England, pp. 78-81.

Soviet Invention Illustrated, Section Ch, Week 8914, 17 May 1989, Derwent Publications Ltd., London, England, Class M21, An 89-105242/14 & SU,A, 1 426 665 (Metal Eng Res Inst) 30 Sep. 1988.

*Primary Examiner*—Lowell A. Larson
*Assistant Examiner*—Thomas C. Schoeffler
*Attorney, Agent, or Firm*—Friedrich Kueffner

[57] ABSTRACT

The invention is directed to a hot-rolling process and a hot-rolling mill for metal strips (5) having one or more roll stands with work rolls (1, 2). In order to prevent surface defects on the work rolls (1, 2), a coolant liquid is sprayed on the entry side in a narrow region extending immediately in front of the roll gap exclusively by a series of flat jet nozzles in such a way that their core jets primarily strike the surface of the work rolls or are directed into the roll gap for direct cooling and in that the entering metal strip is acted upon at the same time by the same coolant liquid for protecting the surfaces of the rolls from the radiated heat of the metal strip. The spraying of the coolant liquid is regulated in such a way that the metal strip is cooled only in a very narrow outer zone. In so doing, the temperature at the surface of the work rolls (1, 2) is adjusted in such a way that it lies below the boiling point of the coolant liquid at least immediately in front of the roll gap.

11 Claims, 1 Drawing Sheet

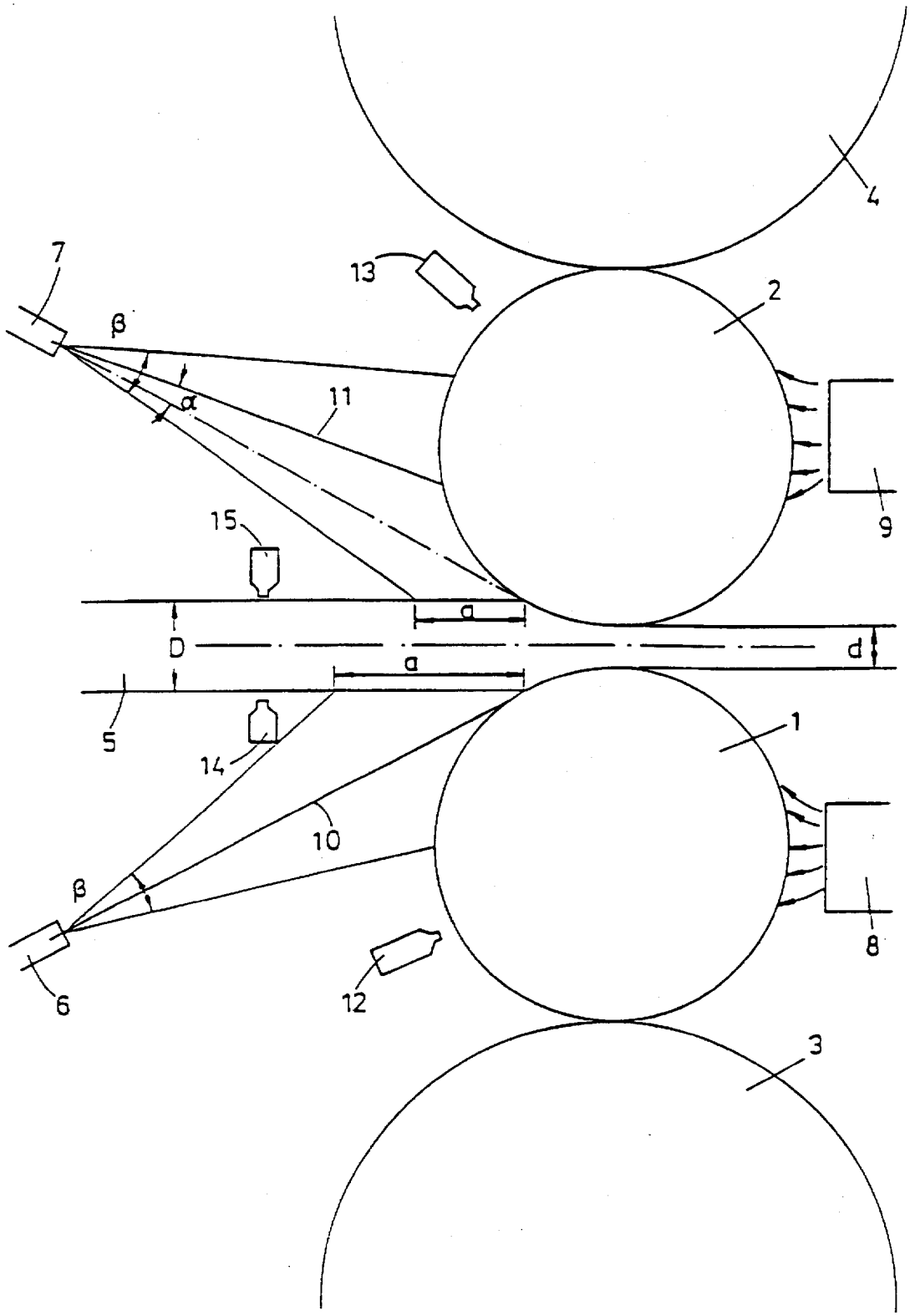
4
7
13
2
β
α
11
9
15
a
D
d
a
5
1
14
10
β
8
6
12
3

HOT-ROLLING PROCESS AND HOT-ROLLING MILL FOR METAL STRIP

BACKGROUND OF THE INVENTION

1. Field of the Invention

The present invention relates to the hot-rolling of metal strips in one or more rolling passes, wherein the metal strip is cooled on the entry side and on the exit side of a roll stand by spraying a coolant liquid against the metal strip and the rolls in a region extending over the entire width of the metal strip.

In the hot-rolling of metal strips in a rolling mill having one or more roll stands, the work rolls are deformed to such a degree as a result of heating that they can no longer be used to roll flat strips. To prevent such deformation, it is known from DE-C2 26 52 845 to cool the work rolls by spraying coolant liquid directly on their outer surface. This spraying is effected primarily on the exit side of the roll stands and wipers are applied to the work rolls, particularly on the entry side of the stands in the event that this side is also to be sprayed with the coolant liquid, which wipers prevent the coolant liquid from coming into contact with the hot metal strip being fed in.

Further, it is known to cool the work rolls both on the entry side and exit side of the roll stands by spraying coolant liquid exclusively and directly on the outer surface of the work rolls (EP-B1 0 191 199). In this case, there are no wipers arranged at the work rolls on the entry side, so that the coolant liquid can penetrate into the roll gap due to the rotation of the rolls and can accordingly come into contact with the entering metal strip so as to be distributed unevenly along its width prior to the roll gap. Since the cooling of the strip along its width is not controlled or regulated and is accordingly not uniform, this leads to the formation of undesirable stripes (so-called cooling stripes) on the upper surfaces of the metal strip. For reasons of quality, these stripes are to be prevented at all events. Although it has been shown in practice that it is possible to oppose deformation of the work rolls by cooling them in this way, surface defects in the form of circumferential flaking (removal of material) still occur at the surfaces of the work rolls even when this method is applied. As with the formation of stripes, this flaking is disadvantageous for the surface quality of the metal strips to be rolled. Finally, it is also known to apply coolant liquid not only to the outer surface of the work rolls, but also to the strip EP-B10 138 503). However, this prior art does not show in particular how the metal strip and the surfaces of the work rolls, in particular on the entry side, are acted upon by the coolant liquid at the same time. In the embodiment example, spray nozzles are associated with the work rolls only on the exit side of the roll stand.

SUMMARY OF THE INVENTION

2. Description of the Related Art

Further, a process for hot-rolling of metal strips in one or more passes is disclosed to the person skilled in the art in SU-A 1 227 275, in which the metal strip is cooled on the entry side and on the exit side of the roll stand or roll stands together with the work rolls by spraying a coolant liquid in a region extending over the entire width of the metal strip. The spraying of a coolant liquid on the entry side is affected in such a way that the surfaces of the rolls directly in front of the roll are cooled to a temperature below the boiling point of the coolant liquid. At each work roll, on the side on which the strip enters the roll gap, there are three spraying zones in arrangements distinct from one another and accordingly three cooling zones which are separate from one another, each of these spraying zones having a distinct function to carry out. This requires complicated plant technique, since a separation of cooling zones can only be achieved by means of complicated mechanical parts. Further, the control technology is extremely complicated for individual spraying zones having different cooling functions. Finally, intensive cooling of the surface of the rolling stock prior to deformation in the roll gap is disadvantageous due to the risk of uncontrolled reactions to rolling force and other shaping conditions.

The object of the present invention is to provide a hot-rolling rolling process and a hot-rolling mill for metal strip in which it is possible to roll metal strips without surface defects caused by defects (flaking or removal of material) on the surfaces of the work rolls.

This object is met with respect to the process in that the invention proceeds from a process for hot-rolling a metal strip in one or more passes according to SU-A 1 227 275 which forms the generic process.

The inventive solution consists in that the spraying of coolant liquid on the entry side is affected in such a way that this spraying is carried out exclusively by a series of flat jet nozzles whose core jets primarily first strike the surface of the work rolls or are directed into the roll gap for direct cooling and in that the entering metal strip is acted upon at the same time by the same coolant liquid for protecting the surfaces of the rolls from the radiated heat of the metal strip, wherein the spraying of the coolant liquid is regulated in such a way that the metal strip is cooled only in a very narrow outer zone.

With respect to apparatus, the object is met proceeding from a hot-rolling mill for metal strips having one or more roll stands with work rolls with spray nozzles for a coolant liquid which are associated with the work rolls at least on the entry side along the entire width of the metal strip to be rolled. The solution according to the invention consists in that only one row of nozzles having flat jet nozzles is arranged on the entry side above and below the entering metal strip, wherein the core jets of all of the spray nozzles of this row of nozzles are directed primarily on the surfaces of the work rolls or into the roll gap.

In accordance with the present invention, the spraying of the coolant liquid onto the metal strip is regulated in such a way that the metal strip is cooled only in a very thin outer zone.

The invention optimizes the cooling of the work rolls in the hot-rolling mills so that the outer surfaces of the work rolls can be maintained at a temperature which is not critical for a deformation of the outer surfaces. However, since the coolant liquid can be applied in a purposeful manner not only to the outer surfaces of the work rolls but also to the sides of the entering hot metal strip which face the work rolls, the coolant liquid sprayed on the metal strip protects the outer surface of the work rolls against the heat radiated from the metal strip. Accordingly, there is no reheating of the already cooled surfaces of the work rolls directly in front of the roll gap as is the case in the method known from DE-C2 26 52 845 employing wipers on the entry side.

Moreover, as the spraying of the coolant liquid on the metal strip is limited to a region located immediately before the roll gap, the metal strip is cooled on both sides only within a very narrow outer zone so that this is not critical for the subsequent deforming between the work rolls. A cooling of the metal strip along the thickness of the strip which is disadvantageous for the rolling step and for deforming is prevented in every case.

The chief constituent of the coolant liquid is preferably water. Conventional lubricants may be added to the water. The boiling point of the coolant liquid accordingly depends on the type and composition of the coolant liquid. Preferably, a coolant liquid which maintains the surface temperature of the work rolls below a temperature of 90° C. to 110° C. should be used. The surface temperature should be brought to and maintained at a value of less than 75° C., in particular less than 50° C. The region acted upon by coolant liquid, which extends as far as the roll gap, should have a maximum width in the rolling direction of 800 mm, preferably less than 500 mm.

According to a development of the invention, the cooling intensity of the sprayed coolant liquid is particularly high when the core jets of the spray nozzles are directed on the outer surface of the work rolls. In this case, the coolant liquid primarily strikes the outer surface and is deflected into the roll gap and onto the metal strip. In this way, favorable turbulence is achieved for a uniform cooling of the metal strip so that no stripes impairing the quality of the strip can be formed on the surfaces of the metal strip, such stripes being prevented.

BRIEF DESCRIPTION OF THE DRAWING

In the following, the invention is explained in more detail with reference to a drawing showing a schematic side view of a section through a roll stand of a hot-rolling mill.

DESCRIPTION OF THE PREFERRED EMBODIMENT

The roll stand has a lower work roll and an upper work roll 1 and 2, respectively, and back-up or supporting rollers 3, 4 supporting the latter. A hot metal strip 5, particularly a steel strip, with a thickness D entering this roll stand is reduced therein to a thickness d. Spray nozzles 6, 7, 8, 9 for a coolant liquid are arranged on the entry side of the metal strip 5 and on the exit side so as to be distributed along the entire width of the metal strip. The spray nozzles 8, 9 on the exit side are directed to the outer surface of the work rolls 1, 2, while the spray nozzles 6, 7 on the entry side are directed substantially on or into the roll gap.

At least the spray nozzles 6, 7 on the entry side are constructed as fan nozzles or flat jet nozzles whose spray cones overlap at the edges at an angle β in such a way that this already achieves a uniform cooling along the width of the metal strip 5. Whereas the core jets 10 of the lower spray nozzles 6 are directed exactly into the roll gap, the core jets 11 of the spray nozzles 7 are deflected into the roll gap at an angle α relative to the jet direction so that they strike the outer surface of the work roll 2 obliquely and are deflected in the direction of the strip 5. This second adjustment or setting of the core jets 11 is preferable because it results in greater turbulence of the coolant liquid and the region of the metal strip 5 comprehended by the spray cone with an opening angle β has a smaller width a than the width a' of the spray cone with the core jets 10 directed exactly into the roll gap. Moreover, this second setting produces a uniform cooling of the metal strip in the regions with widths a and a'.

Temperature gauges 12, 13 are associated with the outer surfaces of the work rolls 1, 2. These temperature gauges 12, 13 determine the surface temperature of the outer surfaces so that the coolant to be sprayed can be adjusted with respect to temperature and volume in such a way that the outer surfaces of the work rolls 1, 2 have a surface temperature lying below the boiling point of the coolant liquid at least immediately prior to the roll gap. Other influencing variables such as the throughput rate of the metal strip 5 and possibly the surface temperature of the metal strip 5 can be determined by additional sensors 14, 15 and taken into account for this proportioning.

What is claimed is:

1. In a process for hot-rolling of metal strip in at least one rolling pass carried out in at least one roll stand, the roll stand having work rolls and a roll gap between the work rolls, the metal strip having a width, the roll stand having an entry side and an exit side, wherein the work rolls and the metal strip are cooled by spraying a coolant liquid onto the work rolls and the metal strip in an area extending over the width of the metal strip, wherein the coolant liquid is sprayed on the entry side such that surfaces of the rolls immediately in front of the roll gap are cooled to a temperature below a boiling point of the coolant liquid, the improvement comprising carrying out spraying of the coolant liquid on the entry side by means of a single row each of flat jet nozzles above and below the metal strip, wherein the spraying nozzles produce core jets directed primarily one of onto the surfaces of the work rolls or into the roll gap, and wherein simultaneously the same coolant liquid is directed in front of the roll gap onto the metal strip such that the metal strip is cooled only in a very thin outer zone for protecting the roll surfaces from radiation heat of the metal strip.

2. The process according to claim 1, wherein the coolant liquid is sprayed onto a portion of the metal strip having a maximum width from the roll gap of 800 mm.

3. The process according to claim 1, wherein the coolant liquid is sprayed onto a portion of the metal strip having a width from the roll gap of less than 500 mm.

4. The process according to claim 1, wherein the coolant liquid is predominantly water.

5. The process according to claim 1, wherein the work roll surfaces are cooled to and maintained at a temperature of less than 110° C.

6. The process according to claim 1, wherein the work roll surfaces are cooled to and maintained at a temperature of less than 75° C.

7. The process according to claim 1, wherein the work roll surfaces are cooled to and maintained at a temperature of less than 50° C.

8. In a hot-rolling mill for hot-rolling metal strip in at least one rolling pass, the mill including at least one roll stand having an entry side and an exit side, work rolls and a roll gap between the work rolls, the work rolls having surfaces, the metal strip having a width, and spray nozzles for spraying a coolant liquid onto the metal strip and the work roll surfaces over an area extending across the width of the metal strip, the improvement comprising the spray nozzles comprising on the entry side a single row each of flat jet nozzles above and below the metal strip, wherein the flat jet nozzles produce core jets, wherein the core jets of the flat jet nozzles are directed primarily one of onto the work roll surfaces and into the roll gap.

9. The hot-rolling mill according to claim 8, wherein each flat jet nozzle produces a spray cone, wherein the spray cones are directed simultaneously onto the work roll surfaces and the metal strip.

10. The hot-rolling mill according to claim 8, wherein the spray cones of the spray nozzles have an angle such that a maximum width of a spraying region on the metal strip in front of the roll gap is 800 mm.

11. The hot-rolling mill according to claim 8, wherein the spray cones of the spray nozzles have an angle such that a width of a spraying region on the metal strip in front of the roll gap is less than 500 mm.

* * * * *